US007231789B2

(12) United States Patent
Chou

(10) Patent No.: US 7,231,789 B2
(45) Date of Patent: Jun. 19, 2007

(54) SNAPPING FABRICS

(76) Inventor: Chao-Mu Chou, 4F, No. 14, Alley 11, Lane 123, Sec. 3, Jen Ai Rd., Taipei (TW)

( * ) Notice: Subject to any disclaimer, the term of this patent is extended or adjusted under 35 U.S.C. 154(b) by 0 days.

(21) Appl. No.: 11/213,751

(22) Filed: Aug. 30, 2005

(65) Prior Publication Data

US 2006/0144098 A1 Jul. 6, 2006

(30) Foreign Application Priority Data

Aug. 31, 2004 (TW) ..... 93213796 U

(51) Int. Cl.
*D04B 7/12* (2006.01)

(52) U.S. Cl. ..... 66/191

(58) Field of Classification Search ..... 66/190, 66/191, 192, 19, 194, 195
See application file for complete search history.

(56) References Cited

U.S. PATENT DOCUMENTS

| | | | | |
|---|---|---|---|---|
| 4,624,116 | A * | 11/1986 | Rogers | 66/193 |
| 4,709,562 | A * | 12/1987 | Matsuda | 66/193 |
| 4,838,044 | A * | 6/1989 | Matsuda et al. | 66/190 |
| 4,931,343 | A * | 6/1990 | Becker et al. | 442/388 |
| 6,096,667 | A * | 8/2000 | Rhode | 66/192 |
| 6,854,297 | B1 * | 2/2005 | Gehring | 66/203 |
| 6,988,386 | B1 * | 1/2006 | Okawa et al. | 66/195 |

* cited by examiner

*Primary Examiner*—Danny Worrell
(74) *Attorney, Agent, or Firm*—Troxell Law Office, PLLC

(57) ABSTRACT

A snapping fabrics comprising of: a micro-fibriform loop fabric, fabricated by complex, spun micro-fiber and splinted thereafter to recover smaller fiber, all of the fibers forming the micro-fibriform loops between the inter-weaving or inter-knitting nodes; a fibriform hook fabric, fabricated by blended spun yarn or synthetic fiber and having a hairiness treatment applied thereafter to form the fibriform hooks for hooking said micro-fibriform loops of said micro-fibriform loop fabrics respectively.

9 Claims, 3 Drawing Sheets

SNAPPING FABRICS

BACKGROUND OF THE INVENTION

1. Field of the Invention

The present invention is relating to snapping fabrics, especially to a fabric combination having the similar snapping effect of traditional VELCRO.

2. The Relating Prior Art

VELCRO, a leading brand of hook and loop fabric, as a conventional snapping or gripping fabrics can be found in our living environment and widely used in garment, leather goods, shoes, diaper, helmet, etc. The major reason is that the VELCRO is convenient in snapping.

However, there are some unsatisfied drawbacks in using VELCRO, for example, VELCRO is stiff in texture, has a certain thickness and is difficult to produced directly connected to the fabric. Normally, it should be by sewing or other ways to attach or connect the VELCRO on the articles which using said VELCRO. Therefore, if the articles using VELCRO requires to be soft in texture or less thick than the thickness of VELCRO, due to the texture of VELCRO material, the VELCRO is difficult to meet such requirements.

Taiwan Utility Model Publication No. 479,477 is relating to thin base fabrics having a snapping surface knitted by a single filament. It disclosed a snapping fabric with a base fabric which formed by each weft filament being knitted to become a node then each adjacent nodes being interlocked to form a pair of inlay, then, by interlocking continuous nodes to form the strips of combining the base warp tissues. That means, the base fabrics of said snapping fabrics is made by single filament, under special knitting for to the curving floating circles thereby providing a thinner VELCRO. The fact prevents the trouble caused by the thickness of VELCRO.

Beside the above-mentioned thickness issue, there is still a problem of unintended adherence. The reason is that the loops of convention snapping fabrics are too large in dimension which providing the opportunity of small things to insert through or fall within the loops.

SUMMARY OF THE INVENTION

Accordingly, the object of the present invention is to provide snapping fabrics having a thinner thickness as well as the smaller, soft micro-fibriform loop fabric and fibriform hook fabric, the each of fabric has micro-fibriform loops and fibriform hooks. Furthermore, the snapping fabrics of the present invention also can be made with the other part of fabrics to become part of fabrics.

DETAILED DESCRIPTION OF THE INVENTION

Figure 1:
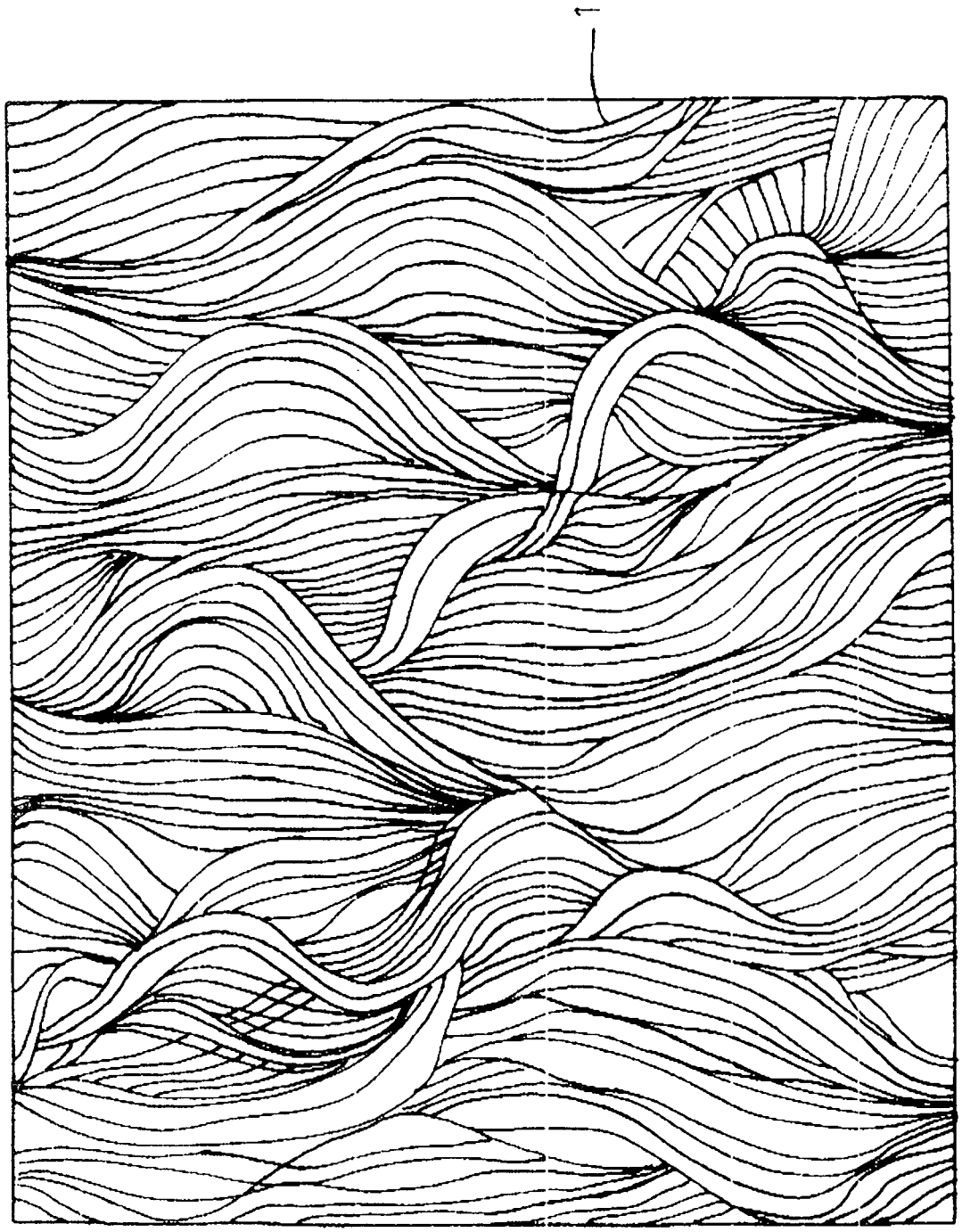
FIG. 1 shows the micro-fibriform loop fabric, which is enlarged 200 times.

As shown in the drawings, basically, the present invention comprise a micro-fibriform loop fabric 1 and a fibriform hook fabric 2.

Figure 3:
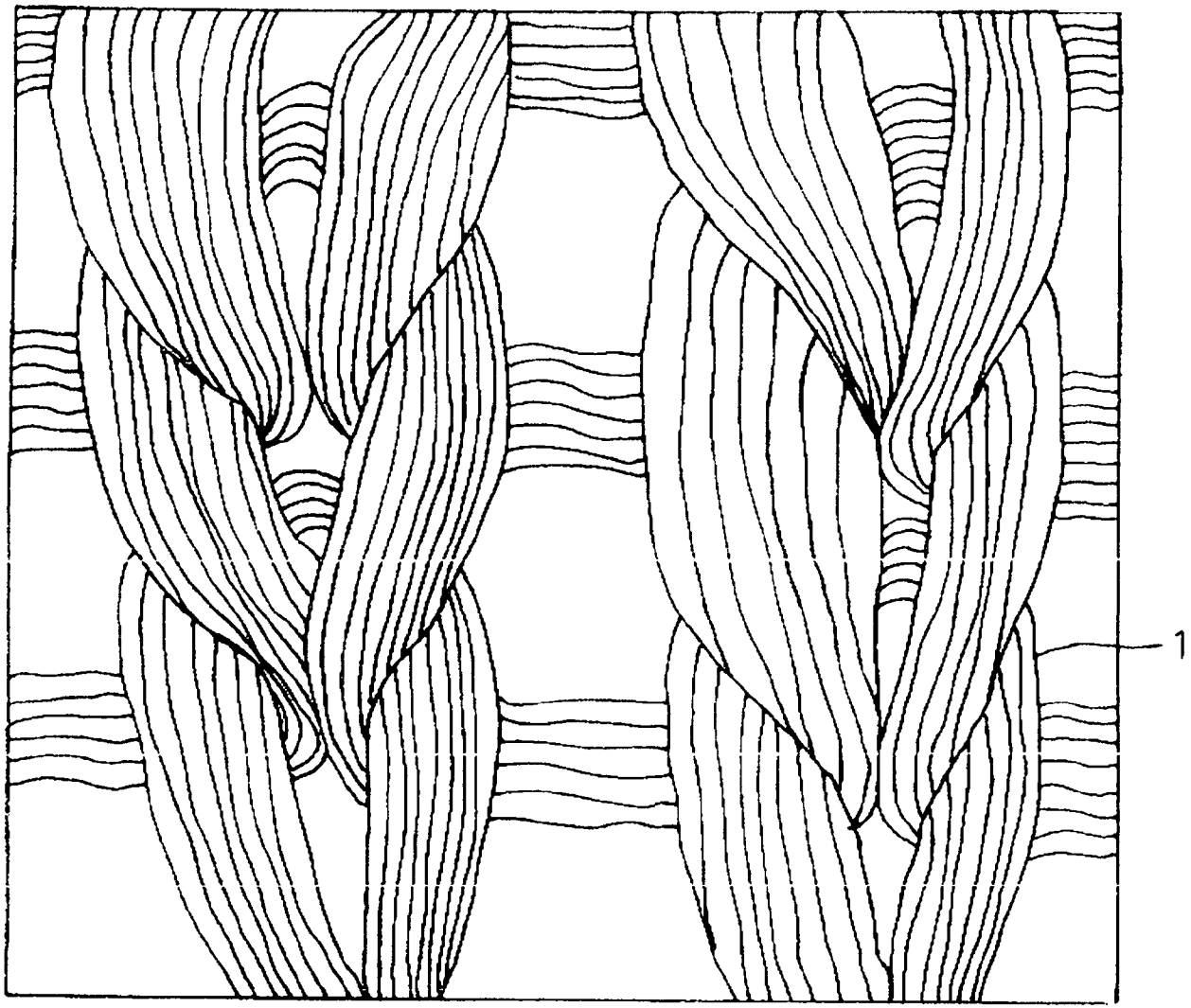
FIG. 3 shows the yarn of micro-fibriform loop fabric which not being splinted, which is enlarged 200 times.

Referring to FIG. 1, the micro-fibriform loop fabric 1 including plurality of micro-fibriform loops which are the intensive and loosen single micro-fiber of the yarn between the inter-knitting nodes. Actually, these micro-fibriform loops are similar to conventional loops but much smaller in dimension. When practiced, the micro-fibriform loop fabric 1 can be made by micro-fiber, which has the diameter, less than 1 denier. The production of micro-fiber is mature technology. As shown in FIG. 3, the normal process may adopt two different high molecular materials become the complex fiber by complex spinning and then separating the each single complex fiber (normally call splitting) into a bunch of micro-fibers. Therefore, the micro-fibriform loop fabric 1 of the present invention is by knitting the micro-fiber yarn then splitting them to form the loosen but intensive micro-fibriform loops between the inter-knitting nodes of the yarn. The method of splitting can be carried out by chemical process as well as mechanical process. The chemical process is by chemical solvent to dissolve one of the materials but leave the other one. If by the mechanical method, two different complex fibers can be separated by mechanically rubbing.

Figure 2:
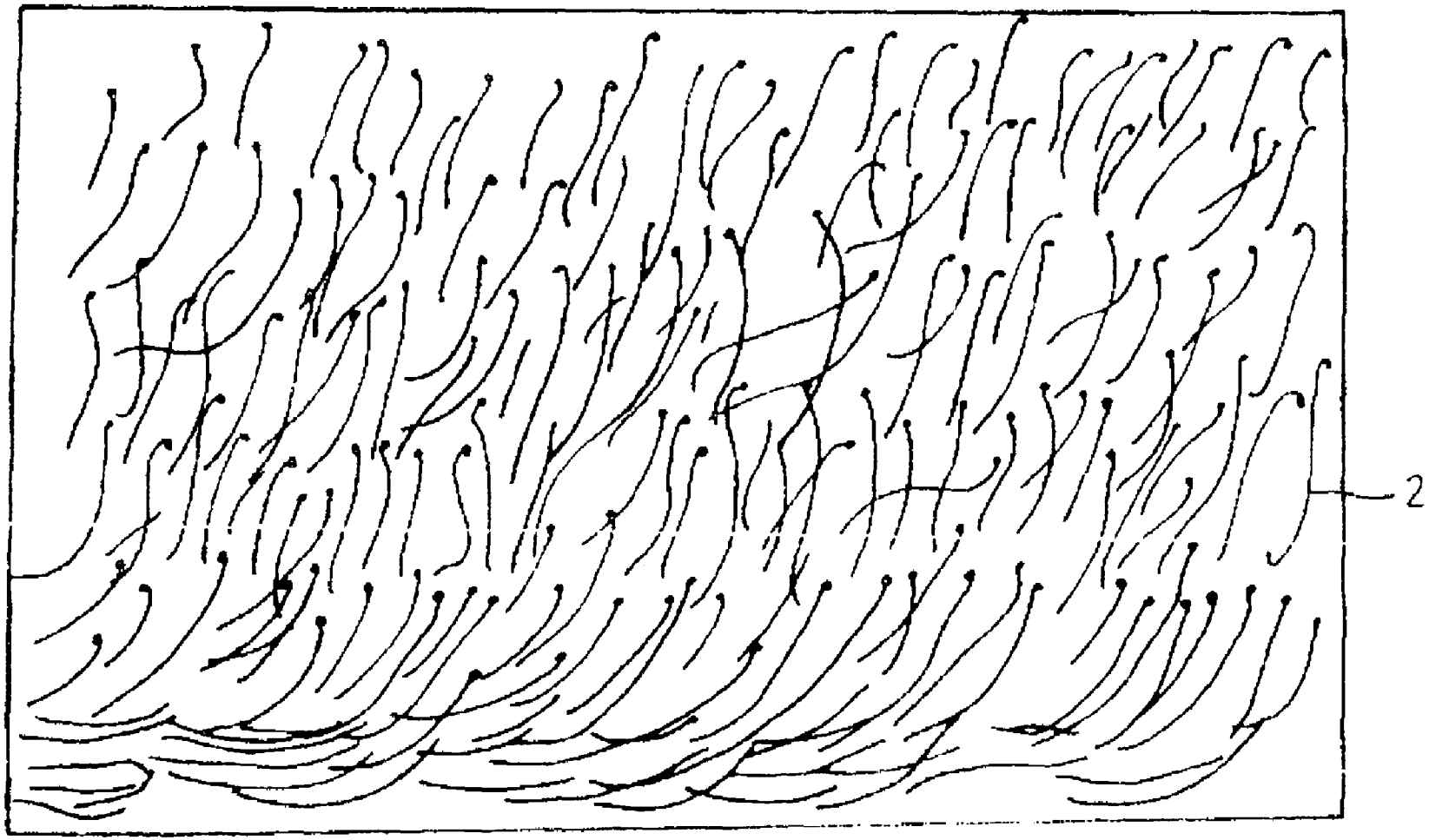
FIG. 2 shows the fibriform hook fabric, which is enlarged 200 times.

Referring to FIG. 2, the fibriform hook fabric 2 including plurality of fibriform hooks, which are knitted by blended spun yarn or synthetic fiber. After knitting, then, no matter filament or staple fiber, all are sheared to form the hairy fibers. Wherein, before the shearing process which may need a brushing process or a further process to melt the end point of fibers. Therefore, the fibriform hook fabric 2 will have plurality of uniform, intensive hairy fibers and with the bead-shaped hook in the end of each fiber.

In practice, when the fibriform hook fabric 2 adheres the micro-fibriform loop fabric 1 face to face, the hairy fibers of the fibriform hook fabric 2 will be hooked or restrained by micro-fibriform loop fabric 1. The way, to achieve the anti-pulling effect or adherence, which the conventional snapping fabrics have.

Therefore, by adopting the present invention, the advantages and effects can be achieved are:

1) The thickness can be effectively reduced due to the use of micro-fiber and knitted them as part of the fabrics directly.
2) Because the snapping fabrics of the present invention forms the loops and hooks directly on the surface of fabrics without base cloth or base substrate, therefore, based on the soft texture, when used as band strip, can be rolled or wrapped more tightly and closely.
3) The diameter of fibriform hook, especially micro-fibriform loop is much smaller than the human hair, except it can prevent the user from skin stimulating, also prevent the other thing from insert or fall within fabrics, by which, maintain the longer adhere life.

In summation of the above description, the present invention herein complies with the patent application requirements and is submitted for patent application. However, the description and its accompanied drawings are used for describing preferred embodiments of the present invention, and it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A hook and loop fabric structure comprising:

a micro-fibriform loop fabric, fabricated by complex, spun micro-fiber yarn and splinted thereafter to recover smaller fibers, substantially all of the fibers forming the micro-fibriform loops between inter-weaving or inter-knitting nodes;

a fibriform hook fabric, fabricated by blended spun yarn or synthetic fiber and applying a hairiness treatment thereafter to form fibriform hooks configured for hooking the micro-fibriform loops of the micro-fibriform loop fabric, wherein the micro-fibriform loops are both formed by and integrated with the loop fabric and wherein the micro-fibriform hooks are both formed by and integrated with the hook fabric.

2. The hook and loop fabric structure as claimed in claim 1, wherein said split is by chemical method to dissolve one of the fibers.

3. The hook and loop fabric structure as claimed in claim 1, wherein said split is by mechanical method to separate the different material fibers.

4. The hook and loop fabric structure as claimed in claim 1, wherein the hairiness treatment of the yarn of said fibriform hook fabric is brushing and shearing.

5. The hook and loop fabric structure as claimed in claim 1, wherein the hairiness treatment of the yarn of said fibriform hook fabric is shearing to form the hooks.

6. The hook and loop fabric structure as claimed in claim 1, wherein the ends of fibers of fibriform hook fabric are melted to form the bead-shaped hooks.

7. The hook and loop fabric structure as claimed in claim 1, wherein the fibriform hooks and micro-fibriform loops are fabricated individually on the opposite surface of fabric.

8. The hook and loop fabric structure as claimed in claim 1, wherein the fibriform hooks and micro-fibriform loops are fabricated on different portions of same surface of fabric.

9. The hook and loop fabric structure as claimed in claim 1, wherein the fibriform hooks of said fibriform hook fabric has a rough surface.

* * * * *